United States Patent [19]

Speer

[11] Patent Number: 4,929,153

[45] Date of Patent: May 29, 1990

[54] SELF-ACTUATING VARIABLE PITCH MARINE PROPELLER

[75] Inventor: Stephen R. Speer, Spokane, Wash.

[73] Assignee: Nautical Development, Inc., Spokane, Wash.

[21] Appl. No.: 216,014

[22] Filed: Jul. 7, 1988

[51] Int. Cl.[5] ..... B63H 3/10

[52] U.S. Cl. ..... 416/46; 416/43; 416/139

[58] Field of Search ..... 416/46, 136, 137, 139, 416/43 R

[56] References Cited

U.S. PATENT DOCUMENTS

| | | | |
|---|---|---|---|
| 1,867,715 | 7/1932 | Seidel | 416/46 X |
| 2,005,343 | 6/1935 | Kent | 416/137 |
| 2,123,193 | 7/1938 | Lilley | 416/43 |
| 2,243,046 | 5/1941 | Algarsson | 416/43 X |
| 2,290,666 | 7/1942 | Ashelman et al. | 416/136 |
| 2,382,229 | 8/1945 | Humphreys | 416/43 X |
| 2,559,767 | 7/1951 | Hatcher | 416/93 A |
| 2,669,311 | 2/1954 | DeLagrevol . | |
| 2,682,926 | 7/1954 | Evans . | |
| 2,694,459 | 11/1954 | Biermann | 416/46 |
| 2,955,659 | 10/1960 | Daley | 416/134 R |
| 2,988,156 | 6/1961 | Coleman | 416/136 R |
| 3,177,948 | 4/1965 | Reid . | |
| 3,229,772 | 1/1966 | Miller . | |
| 3,231,023 | 1/1966 | Marshall | 416/43 |
| 3,275,083 | 9/1966 | Allin | 416/134 R |
| 3,275,610 | 1/1967 | Frias . | |
| 3,302,725 | 2/1967 | Brimble et al. . | |
| 3,403,735 | 10/1968 | Langhjelm et al. | 416/167 |
| 3,790,304 | 2/1974 | Langlois | 416/93 A |
| 4,304,524 | 12/1981 | Coxon | 416/131 |
| 4,419,050 | 12/1963 | Williams | 416/157 R |
| 4,599,043 | 7/1986 | Müller | 416/167 |

FOREIGN PATENT DOCUMENTS

| | | | |
|---|---|---|---|
| 3429297 | 2/1986 | Fed. Rep. of Germany | 416/137 |
| 418288 | 2/1947 | Italy | 416/166 |
| 449247 | 6/1936 | United Kingdom | 416/46 |
| 496750 | 12/1938 | United Kingdom | 416/53 R |

*Primary Examiner*—Everette A. Powell, Jr.
*Attorney, Agent, or Firm*—Barry G. Magidoff

[57] ABSTRACT

There is provided a self-actuating, variable pitch propeller having a plurality of blades. All of the blades are automatically movable between a first, relatively lower pitch position and a second, relatively higher pitch position, substantially simultaneously and equally in response to achieving a predetermined combination of propeller rotational speed and hydrodynamic loading on the propeller blades. The blades are releasably locked to prevent the pivoting of each blade when in the locked position. The locking means are released by actuating means activated by the combined effects of centrifugal force and hydrodynamic loading.

11 Claims, 14 Drawing Sheets

FIG. 11
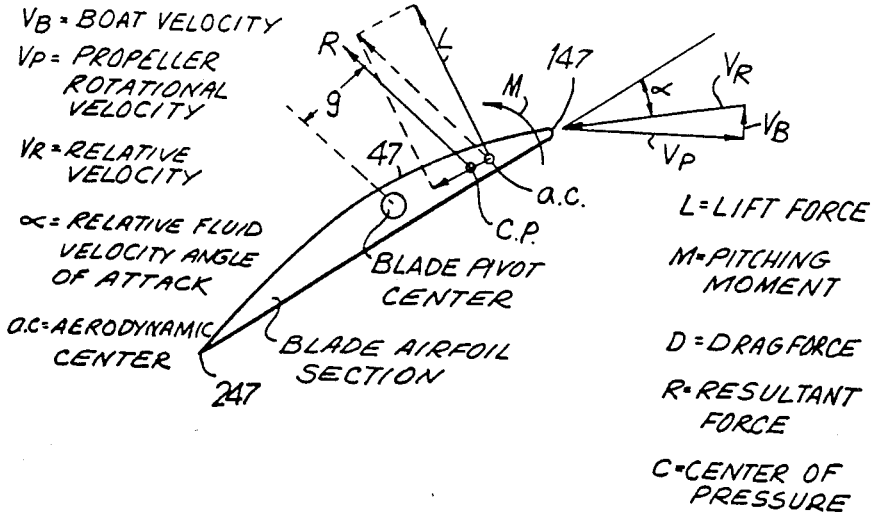
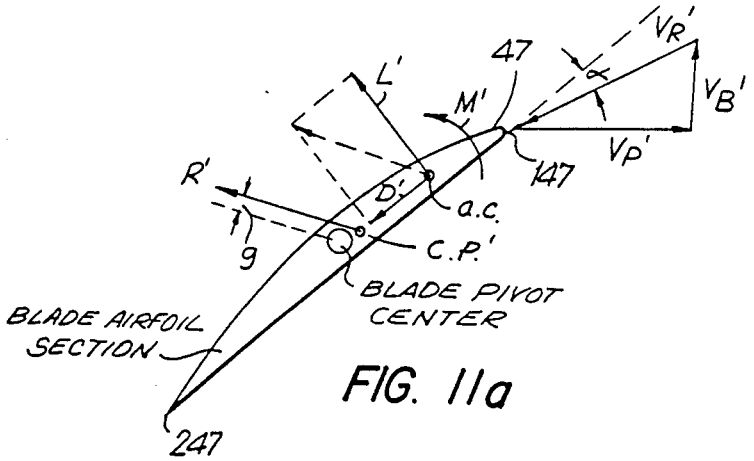
FIG. 11a $$M_B = \frac{w}{g} t\omega^2 \cos\beta \sin\beta 2 \int_{z-0}^{z-b/2} \int_{R-R_1}^{R-R_0} x^2 dx dR$$

COUNTERWEIGHT ORIENTATION TO PROVIDE INERTIAL BIAS TOWARD HIGH PITCH POSITION (VIEW LOOKING RADIALLY INWARD)

SELF-ACTUATING VARIABLE PITCH MARINE PROPELLER

This invention relates to self-actuating variable pitch marine propellers wherein the blade pitch is automatically variable between two discrete pitch positions.

BACKGROUND OF THE INVENTION

It has long been recognized that the angular pitch of a propeller's blades is significant in determining the efficient operation of the propeller propulsion system, whether for a boat or an aircraft. For marine propellers, propeller blade pitch is often defined in terms of "inches", i.e., defining the distance that a boat would be propelled through the water by a single revolution of the propeller, assuming no slippage, e.g. a propeller having a pitch of "13 inches", is one having the blade angle necessary to linearly advance the boat 13 inches upon one complete revolution of the propeller.

It has similarly been well understood that the conditions under which the boat will operate are important in determining the optimum pitch for the propeller, for an engine producing a certain maximum power output Such operating conditions include the load, intended speed of the boat, and the type of hull, of the boat being propelled. In the past, the majority of boat propulsion systems whether inboard, outboard or stern drive, have been designed to use a single pitch propeller, wherein the propeller was changed depending upon the boat to which the engine would be attached, and its intended use. For example, when a boat was to be used for towing a water-skier, i.e where the boat is subjected to a relatively heavy load, a propeller having a lower pitch would be selected, e.g. approximately a 15" pitch for a relatively small, 16 feet long outdoor pleasure boat with a 100 h.p. engine. Similarly, a higher speed boat with, e.g. a 300 h.p. engine would use a relatively high pitch blade, e.g. a 21"-pitch propeller Designers have also long recognized that such fixed pitch propellers are at best compromises which produce fully acceptable performance only over a relatively narrow range of operating conditions, e.g. either slow speed or fast speed operation, but not both.

Past workers have designed propellers which have manually resettable blade pitch positions. Thus, the pitch of the propeller can be modified based upon the anticipated overall use to which a boat will next be put; however, such pitch was set before starting the engine, and the pitch remained constant during continued engine operation. Thus, if a boat was to be used for water-skiing, a relatively lower pitch would be selected and the boat operated at that constant pitch during the entire operating session. A lower pitch propeller permits the engine to operate at a high rotary speed, and thus develop large amounts of power at a relatively low boat speed. However, the constant lower pitch reduces the effective top cruising speed. Such a device is shown for example in U.S. Pat. No. 3,790,304. Other past designs have manually resettable blade positions that allow changes in the blade pitch position during operation. These have provided for manual adjustments made via mechanical, hydraulic or electric means. Such devices are shown for example in U.S. Pats. No. 2,554,716, 3,216,507, and 4,599,043.

The prior art, recognizing the utility of propellers which vary blade pitch during operation of the engine, have devised various means of changing the pitch either in accordance with a self-actuating design, i.e. the pitch automatically changes based upon changes in operating conditions, e.g., engine RPM, or by operator-controlled means, such as pneumatic or hydraulic controllers. Self-actuating propellers, which are apparently continuously variable over a range of pitch positions, are suggested for marine propellers by Reid in U.S. Pat. No. 3,177,948, and for aircraft propellers by Lagrevol and Biermann, in U.S. Pat. Nos. 2,669,311 and 2,694,459. A propeller, especially adapted for an outboard engine for marine use, having both manual and automatic self-actuating variable pitch means, is shown in U.S. Pat. No. 2,682,926, to Evans.

Other devices which provide for automatic, self-actuated changes in blade pitch positions, wherein the blades are spring biased against change, is shown for example in U.S. Pat. Nos. 2,290,666, 2,988,156; 3,145,780; 3,204,702; 3,229,772; 3,231,023; 3,295,610; and 3,567,336. In addition, there have been variable pitch marine propeller designs which are actuated by a sudden, or sharp, change in engine RPM to provide the necessary impetus to shift the blade pitch. Examples of such devices are shown in U.S. Pat. Nos. 3,275,083 and 3,302,725.

Prior self-actuating propellers intended primarily for uses on aircraft have incorporated means to lock the blades in one or more blade positions. Such devices are shown for example in U.S. Pat. Nos. 2,669,311 and 2,694,459, and German Patent publication No. DE 3,429,297.

GENERAL OBJECTS

It is an object of the present invention to provide, especially for a marine propeller, dependable self actuating means for shifting between a first, lower pitch blade position, and a second, higher pitch blade position, with changes in such boat operating conditions as engine RPM and boat speed and/or boat acceleration. It is a further object of the invention to provide dependable, self-actuating pitch-changing means that will change in response to achieving a pre-determined boat speed, which varies based upon the rate of acceleration, whether in engine RPM or in boat speed, especially when operating a planing hull-type boat. It is yet another object of this invention to provide means to automatically change marine propeller pitch at a predetermined engine speed range which is dependent upon the load on the engine.

A still further object of this invention is to provide a propeller blade pitch-shifting mechanism which will prevent blade flutter and/or propeller rpm hunting during boat operation regardless of changes in hydrodynamic load on the propeller. It is yet another object of this invention to affirmatively lock the propeller blade into a defined or discrete, pitch position until predetermined hydrodynamic conditions are achieved to remove the lock and so permit a change in the blade pitch. It is a further object of this invention to provide a variable pitch marine propeller which is self-contained and thus capable of being inter-changed with a fixed pitch propeller without otherwise modifying the engine or drive train. It is yet another object of the present invention to provide a variable pitch marine propeller which will permit engine exhaust gases to pass internally through the propeller hub from the engine drive shaft.

It is a further object of this invention to provide a variable pitch propeller incorporating an elastic coupling between the propeller hub and drive shaft to provide vibration and shock isolation to the drive system.

GENERAL DESCRIPTION OF THE INVENTION

In accordance with the present invention, there is provided a self-actuating, variable pitch propeller having a plurality of blades, wherein each blade is automatically movable between a first, relatively lower pitch position and a second, relatively higher pitch position and, wherein the blades are all movable substantially simultaneously and equally in response to achieving a predetermined combination of propeller rotational speed and of hydrodynamic loading on the propeller blades. The self-actuated, variable pitch marine propeller of the present invention comprises a hub designed to be rotatably secured to a power source; a plurality of blades pivotally secured to the hub, each blade being secured about a pivot axis; releasable pivot locking means to prevent the pivoting of each blade when in the locked position; pitch change means to cause the blades to pivot when the pivot locking means are released; and coordinating means to assure substantially equal and simultaneous pivoting movement of all of the blades.

BRIEF DESCRIPTION OF THE DRAWINGS

A further understanding of the present invention can be obtained by reference to the preferred embodiment set forth in the illustrations of the accompanying drawings The illustrated embodiment however is merely exemplary of systems for carrying out the present invention. The drawings are not intended to limit the scope of this invention, but merely to clarify and exemplify without being exclusive thereof Referring to the drawings:

FIGS. 11 and 12 are generalized sketches describing the forces acting on the propeller blades;

FIG. 11*a* is a higher speed representation of the blade forces shown in FIG. 11;

Figure 1:
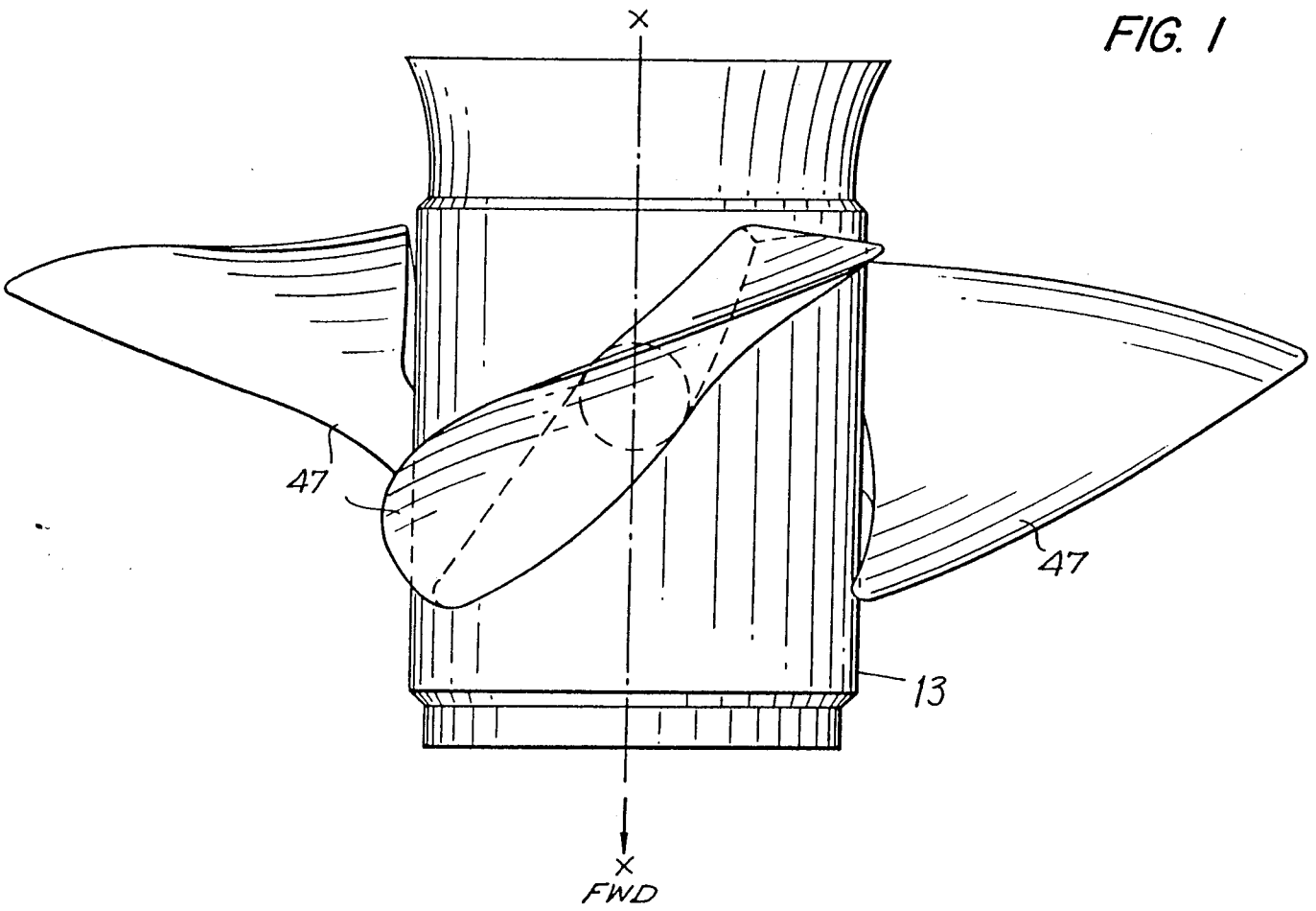
FIG. 1 is a side elevation view of a preferred embodiment of the variable pitch marine propeller of the present invention, having three equally spaced propeller blades.
Figure 2:
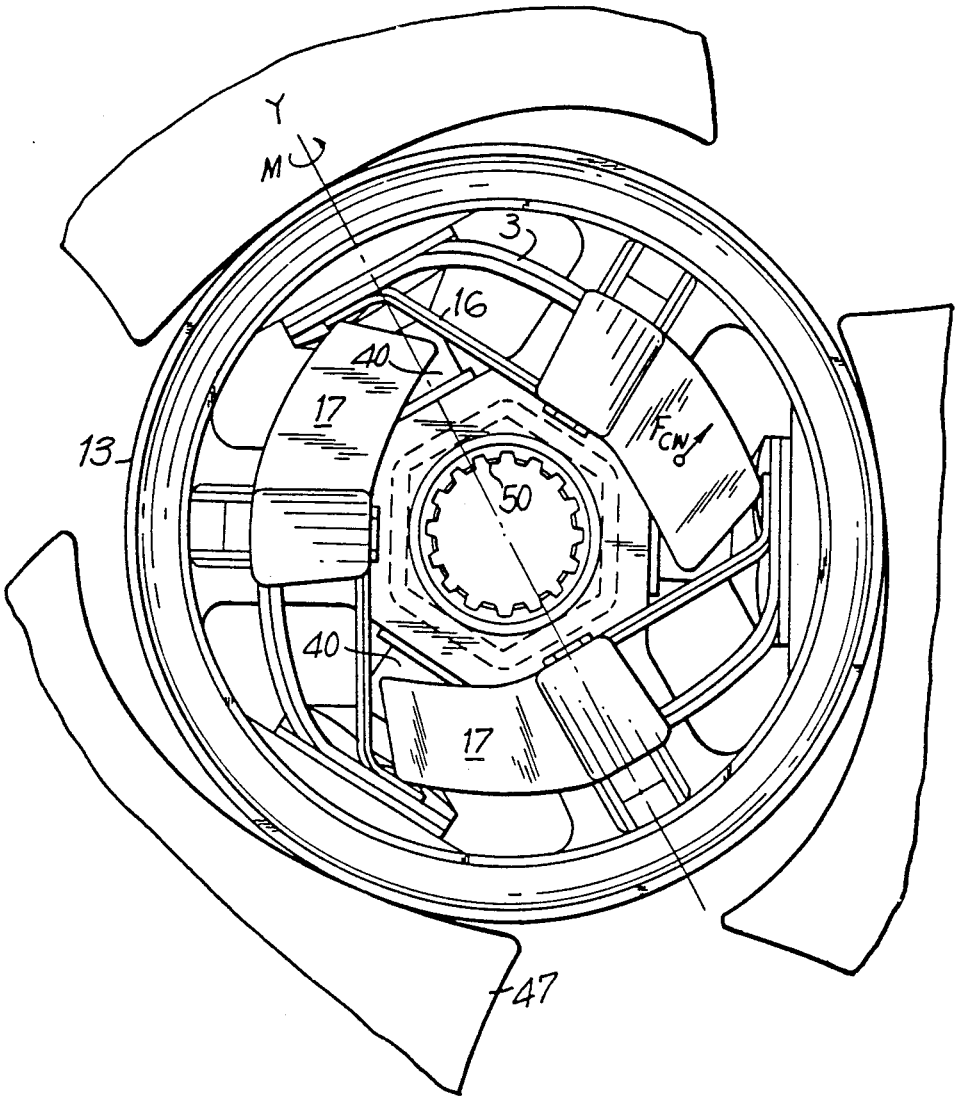
FIG. 2 is a rear end view of the variable pitch marine propeller of FIG. 1.
Figure 3:
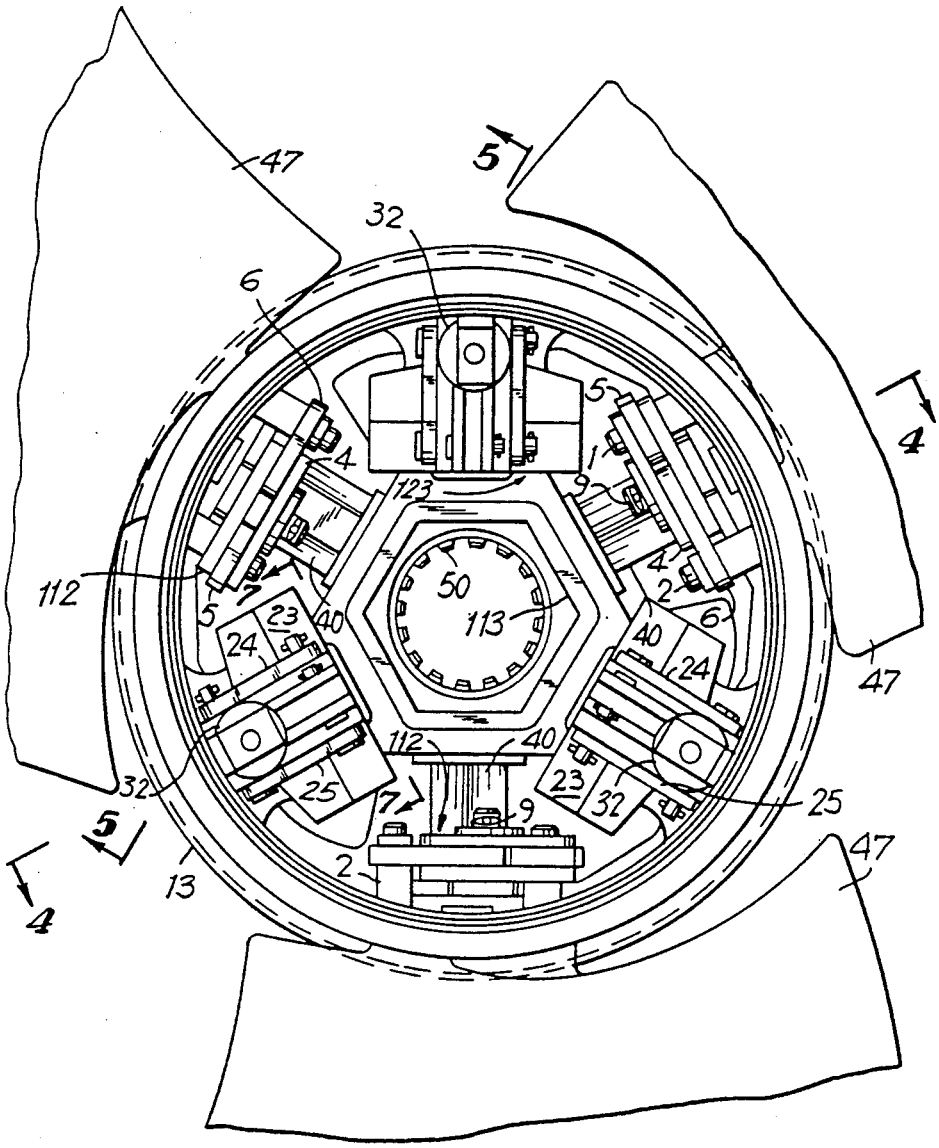
FIG. 3 is a front end view of the variable pitch marine propeller of FIG. 1.

The present invention utilizes the relationship between the hydrodynamic forces, lift ("L"), Drag ("D"), and Pitching Moment ("M"), and the inertial turning moments ($M_B$) acting upon the propeller blades, in a manner which was not previously recognized to be useful. The computations needed to define these forces have been generally well established by current engineering theories, but the interaction of all these factors had not previously been formulated in connection with the operation of an automatic, self-actuating variable pitch propeller. For the present invention, these computations are utilized to determine the dynamic load conditions acting on the propeller blades, with changes in boat velocity and acceleration and propeller (or engine) rotational speed (RPM), as the factors to be considered in the design of a self-actuating variable pitch propeller.

Referring to the drawings, a hub, generally indicated by the numeral 13, is rotatably connected to three propeller blades 47. This propeller is designed to be detachably secured, without any further change, to an outboard engine or stern drive system in place of a conventional fixed blade propeller. The present invention can also be fitted to an inboard engine drive shaft.

Concentrically located within and fixed to the hub case 13 is an inner hub 113. The blades 47 are each secured to a retainer shaft 40, extending radially and being journalled through the outer hub 13 and to the inner hub 113, supported by two cylindrical bearing supports 44, 45. A hexagonal head end 41 secures each shaft 40 to the blade 47, and to a blade arm 3. The three blade arms 3, extend axially along the hub, adjacent the interior surface of the outer hub 13, so as to pivot together with its respective blade 47.

Slidably located within and concentric with the hub 13 is a coordinating ring 11, axially movable relative to the hub 13. The forward end 3*b* of the blade arm 3 is located radially inwardly of the coordinating ring 11 and is pivotally movable between two anchor pins 1, 2 which are secured to the inner wall of the coordinating ring 11.

Figure 6:
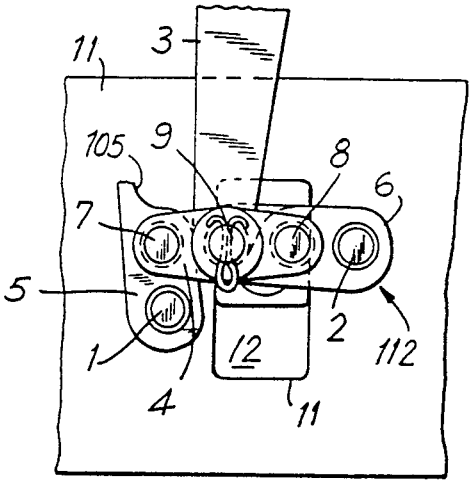
FIG. 6 is an enlarged detail view of a portion of FIG. 5*a;*

The locking mechanism, and lock release mechanism, for each blade is of the type generally known in kinematics as a four-bar linkage. In the illustrated embodiment, the locking assembly is a bell crank assembly generally indicated as 112 (shown in enlarged detail in FIG. 6), and comprises a central link, or bell crank 4, and two end links 5, 6. The inner ends of the two end links 5, 6 are pivotally connected to the ends of the bell crank 4 by two bell crank pins 7, 8. The outer ends of each of the end links 5, 6 are rotatably secured to the anchor pins 1, 2, respectively. A central bell crank pivot pin 9 pivotally connects the bell crank 4 to the forward end 3*b* of the blade arm 3.

Figure 5:
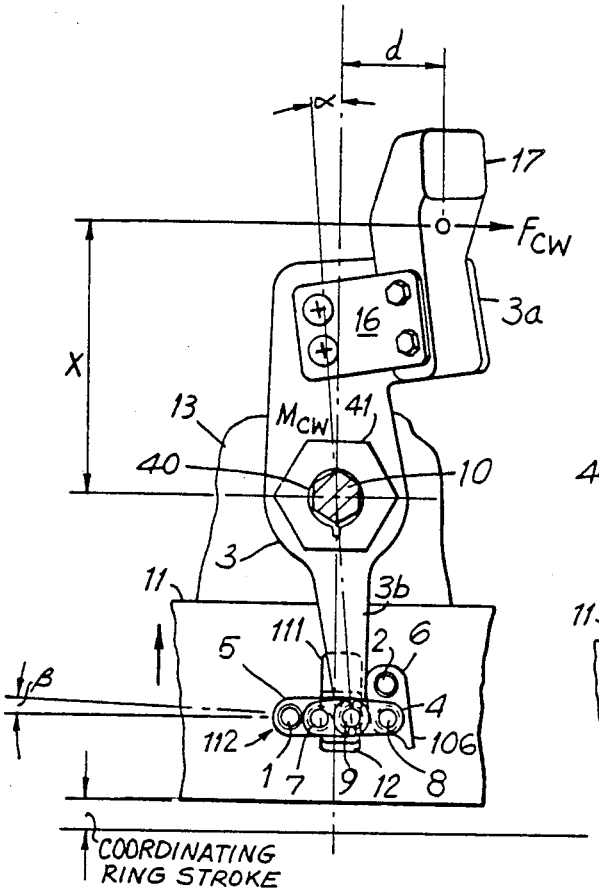
FIG. 5 is a partial cross-sectional view taken along lines 5 of FIG. 3.

The geometry of the bell crank linkage assembly 112 is such that in the low pitch locked position shown in FIG. 5, an anchor pin 1, the bell crank pins 7, 8, and the central bell crank pin 9 are positioned substantially along a straight line. When in the high pitch locked position of FIGS. 5*a* and 6, the other anchor pin 2, and the bell crank pins 7, 8, 9 are positioned substantially along another straight line, one located rearwardly of the low pitch straight line. Thus, the axial distance between the two anchor pins 1, 2 i.e. from the front to the rear of the hub, must substantially be equal to the distance between the two pins 1, 7 and 2, 8, respectively in each of the two end links 5, 6.

Secured to the rearward end of the blade arm 3, which at its forward portion 3*b* is substantially a flat plate, is a curved arm 3*a* extending out of the plane of the forward portion of the blade arm 3*b*, radially inwardly of the hub and tangentially offset in the direction of rotation of the propeller from the flat portion of the blade arm 3*b*. Secured to the outer end of the curved arm 3*a*, is a relatively heavy counter-weight 17 having a mass approximating that of the blade, e.g. preferably, at least about 70% of the mass of the blade 47, further supported from the blade arm 3 by a brace 16. Alternatively, the blade arm 3 and counter-weight 17 can be formed as an integral unit, if desired The counter-weight 17 is oriented in this manner, relative to the blade pivot axis 10, so that the centrifugal force acting on the counter-weight 17 creates a turning moment about the blade pivot axis 10, acting to rotate each blade 47 toward a higher angle of pitch.

A pitch change actuating and return mechanism, which serves to release the locked bell crank linkage mechanism 112 is provided by one or more slider mechanisms, generally indicated by the numeral 123, which serves to move the coordinating ring 11 with a change in engine, or propeller, rotational speed. An anchor block 20 is rigidly secured to the inner surface of the hub 13. A curved pivot link 22 is pinned at one end to the block 20 by pin 27; the second end of the pivot link 22 is also rotatably secured to an actuating weight 23 by another pin 28. One end of a straight link 24 is also pivotally pinned to the actuating weight 23 by the pin 28; the second end of that straight link 24, in turn, is pivotally connected by a pin 29 to a slider block 26. The slider block 26 is rigidly secured to the forward end of the coordinating ring 11. A second optional pair of links 21, 25, acting along lines parallel to the first pair of links 22, 24, respectively, can be pivotally secured between the actuating weight 23 and the anchor block 20 and the slider block 26, respectively, to provide additional support. The optional support links 21, 25 are so disposed that the curved optional link 21 moves parallel with the curved link 20, and the optional straight link 25 moves parallel with the straight link 24.

An actuator biasing spring 31 is pressed between a flange 32 on the inner surface of the hub 13, at its forward end, and to a button 30 secured to the coordinating ring 11, at its rearward end, such that the coordinating ring 11 is biased towards the rear of the hub 13. The geometry of the actuating weight links 21, 22, 24, 25 is such that the effective force exerted by the actuating weight 23 against the spring biased coordinating ring 11 increases as the weight moves radially outwardly towards the hub 13, i.e. the links 21, 22, 24, 25 provide an improved mechanical advantage as they rotate outwardly: the two rearmost curved links 21, 22 rotate clockwise and the two forward-most straight links 24, 25 rotate counterclockwise, as the weight 23 moves radially outwardly.

In designing a self-actuating, pitch-changing mechanism for a particular propeller blade configuration, certain physical principals of dynamic force relationships must be considered. The means for determining these dynamic forces are individually well known to the art and their computation is readily accomplished by following currently available engineering computation methods. However, the inter-relationship of these forces has not previously been utilized in this context.

Considering first the hydrodynamic forces acting upon the propeller blade surfaces, the marine propeller blade is a lifting body, or hydrofoil, acting similarly to an aircraft wing. The combined hydrodynamic forces created by the rotation of the propeller generates a thrust to propel the boat. The resultant hydrodynamic force acting on each blade changes significantly, both in magnitude and in location on the blade, depending upon the relative water velocity and angle of attack, which are in turn related to the boat's forward velocity and propeller rotational speed.

In conventional aerodynamic theory (*Theory of Flight*, by Richard Von Mises, Dover Publications, 1959, and *Foundation of Aerodynamics*, by A. M. Kuethe & J. D. Schetyer, John Wiley & Sons, 1959) the algebraic summation of the pressures acting over the entire airfoil, or blade surface, can be represented as a single, resultant hydrodynamic force, having its point of application defined as the "center of pressure" ("c.p."). Conventionally, the "aerodynamic center" ("a.c."), of a blade, or airfoil, is defined as a point where the airfoil section pitching moment coefficient does not change but remains constant regardless of changes in the fluid angle of attack of the blade. For conventional airfoil sections, the aerodynamic center is generally between the 23 and 27 percent chord position and is commonly estimated to be at the 25 percent chord position. Furthermore, for most conventional airfoil sections (e.g. NACA Series 16), the pitching moment coefficient is negative, i.e., tends to bias the airfoil toward a lower angle of attack (pitch). For this automatic, self-actuating variable pitch position marine propeller, the vector magnitude and direction of the resultant hydrodynamic force and the location of the center of pressure relative to the blade pivot axis are the major parameters in determining the timing of the pitch change.

Referring to FIG. 11, which describes the instantaneous forces acting upon a propeller blade as the boat is initially accelerated and at a relatively low boat velocity ($V_B$), the resultant hydrodynamic force ("R") acting upon the propeller blade 47 is a function of the lift force ("L"), the drag force ("D") and pitching moment ("M"). The center of pressure for such low boat velocity with high propeller rotational velocity is located relatively close to the blade's leading edge 147, e.g., at approximately the 20% mean aerodynamic chord ("MAC"). As the boat's velocity ($V_B'$) through the water increases, however, the drag force increases (to D'), the pitching moment increases to (M'), and the lift force decreases (to L'), such that the resultant hydrodynamic force vector (R') is changed in both magnitude and direction. Even more significant, the center of pressure moves aft (to C.P.') towards the trailing edge 247 of the blade, e.g., the center of pressure can move to about the 60% MAC location, under high velocity, low angle of attack conditions. Generally when the boat linear speed and propeller rotational speed are at their respective maximum operating levels the center of pressure will lie between the 35% to 55% MAC range.

The resultant hydrodynamic force ("R") acting on each propeller blade 47 is the direct vector sum of the torque force (Q) and thrust force (T) components, i.e.

$$R = \sqrt{T^2 + Q^2},$$

Very rough approximations of the torque force (Q) and the thrust force component (T) at a constant speed, can be obtained by the following formulae:

$$T=n375h/vN,$$

wherein h is engine horsepower, n is propeller efficiency, V is the boat velocity (mph) and N is the number of blades on the propeller;

$$Q=t/rN,$$

wherein t (torque)=63000h/s; r is the radial distance from the propeller shaft centerline to the blade center of pressure, and s is the rotational speed of the propeller (RPM).

The above formulae can be rendered somewhat more precise by following the methods set forth in current engineering literature, for example, in T. P. O'Brian, "*THE DESIGN OF MARINE SCREW PROPELLERS*", (Hatchinson Scientific and Technical, 1969).

The resultant hydrodynamic turning moment ("$M_h$") acting on each blade at the pitch change condition can be calculated as follows: $M_h=Rg$, wherein R is the absolute value of the hydrodynamic vector, R, as calculated above, multiplied by the perpendicular distance (g) between the vector R and the blade pivot center. The value of "g" is in turn determined by the location of the center of pressure (c.p.'), and the direction of the vector R' at the conditions of pitch change. The location of c.p. can be determined for each blade design and operating parameters, in accordance with well-known aerodynamic or hydrodynamic methodology, as explained more fully in the above-cited texts.

Figure 12:
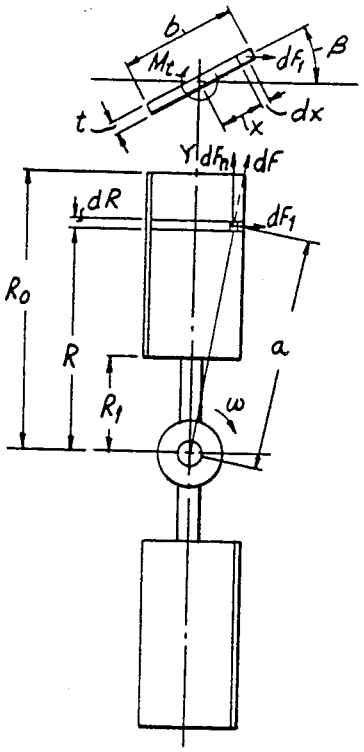

Another force independently acting to change the pitch position of the blade is the propeller blade rotational, or inertial, force moment ($M_B$). In determining the magnitude of this inertial force, the blade can be approximated as a thin curved plate having its mass distributed within a plane intersecting the blade pivot center line, as shown in FIG. 12 (for calculating out the moment "M", from the equation in FIG. 12). This inertial force tends to move the blade in a direction to reduce its pitch, and is proportional to the square of the rotational speed of the blade. Procedures for calculating inertial turning moments of propellers are described in current engineering literature, for example, in H. Mabine and F. Ocvik, "*MECHANISMS AND DYNAMICS OF MACHINERY*", (John Riley and Sons, Inc. 1963).

Experience has shown that the preferred low pitch position of the variable pitch propeller of the present invention, e.g., for pleasure boats with engines rated at from 100 to 300 horsepower, should be in the range of from about 12" to about 16", and the high pitch position for such craft should be in the range of from about 17" to about 23". The optimum settings of propeller pitch are a function of the design speed of the boat in combination with the engine speed, and propeller: engine speed drive ratio. For highly powered speed boats, having a high horsepower-to-weight ratio, such as boats that are capable of speeds in excess of 50 MPH, a high-pitch of as great as 28", can be used. Between the extreme limits of high and low-pitch positions, the angular rotation of each blade can be in the range of from about 4 to about 12 degrees, but preferably not greater than about 7 to about 9 degrees. This is generally sufficient to provide the desired flexibility and economy of operation, with a reasonable size and efficiency.

For minimizing the magnitude of the force needed to pivot the propeller blades between the low and the high pitch positions, the magnitude of the resultant hydrodynamic moment about the blade pivot center should be as low as possible, at the conditions of the pitch change. For this purpose, the blade pivot center should be located such that the center of pressure for the resultant hydrodynamic force, at the time the blades are to pivot, is as close to the pivot center as is feasible. It has been found most effective to locate the pivot center for each blade along a line between the 35% and 55% mean aerodynamic chord, when viewing the blade geometry in a developed or planar representation, i.e. a view where all blade section chord lines are represented in a common plane by removing the blade section angular twist and rake components. Further, when dealing with conventional NACA 16 series airfoils, the blade pivot center is most preferably located between the 45% and 50% MAC.

Figure 10:
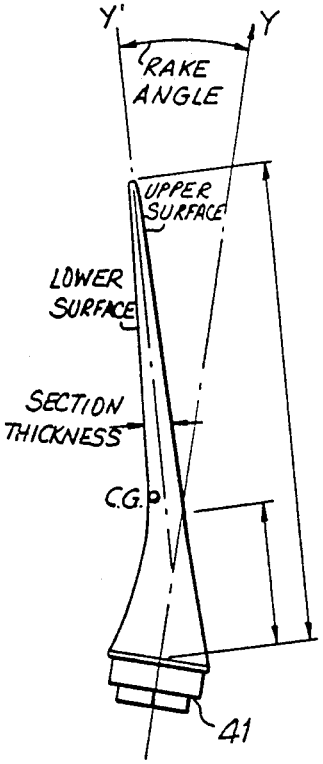
FIG. 10 is a cross-section view taken along lines 10—10 of FIG. 8.
Figure 9:
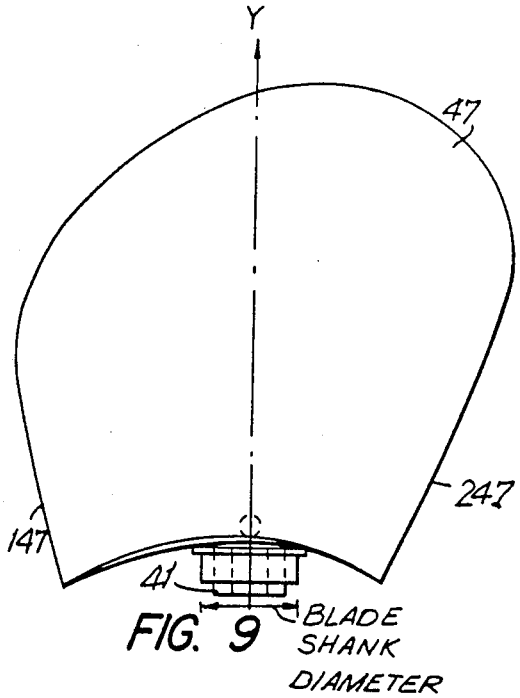
FIG. 9 is a plan view of the propeller blade of FIG. 8.
Figure 8:
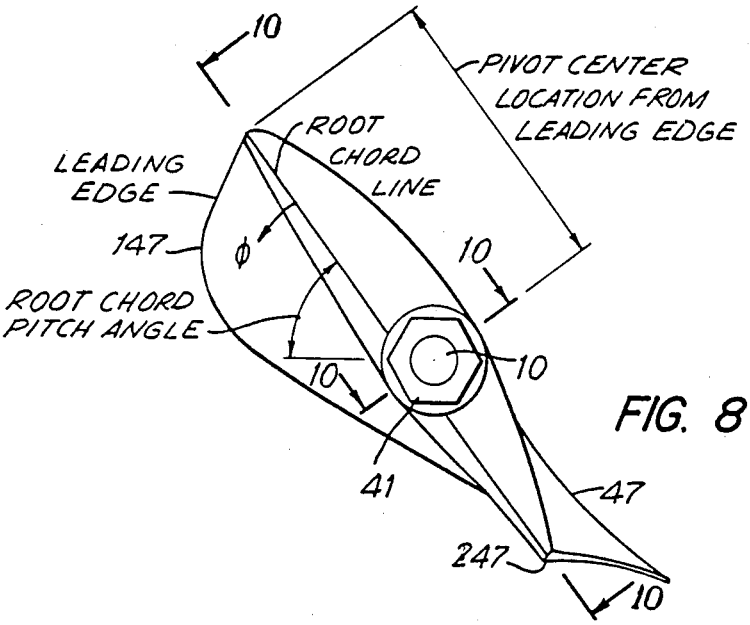
FIG. 8 is an end view of a single propeller blade.

Typical propeller blade geometry is shown by FIGS. 8, 9 and 10. This design, useful in the variable pitch propeller of the present invention, is typical of conventional design practice with the exception of modifications made to provide adequate structural strength and efficient fluid flow characteristics adjacent the pivot center 10 location.

The blade 47 is thus modified to accommodate the pivot center location near the root chord regions. The modification region extends outwardly from the root chord for approximately one-quarter of the blade span. The blade shank 42 diameter is preferably from about 17 to about 25% of the total blade span, i.e., distance from the hub outer surface to the blade tip, to provide sufficient structural strength. In order to minimize the fluid flow degradation in the modified, or thicker, root chord region, a higher thickness-to-chord ratio airfoil is provided from the outer portion of the modified region towards the root section. The design chord length at the root section is preferably in the range of from about 0.8 to about 1.3 times the length of the blade span. The actual root chord length is generally less than the design chord length to facilitate manufacturing.

The thickness of the blade airfoil section at the outer point of the modified region is typically from about 8% to about 10% of the chord length, and is then linearly tapered downwardly to a thickness of from about 2% to about 4% of the chord length at the blade tip. The root section airfoil should have a maximum thickness of from about 18% to about 22% of the root chord design length. Outward of the modified root chord region (as illustrated in FIG. 10), the blade generally presents a constant rake angle of between 12 and 17 degrees. Table I, referring to FIG. 10, exemplifies blade design geometry, in tabular form, for boats of from 1500 to 5000 lbs total weight, powered by engines having from 100 to 400 horsepower, with maximum propeller rotational speed of from about 1500 to about 4000 RPM. The pivot center location of the blade is positioned between the 45 to 50% MAC position, and substantially centered in the root section between the upper and lower airfoil contour lines

TABLE 1

BLADE DATA, NACA 16 SERIES AIRFOILS

| y | Design Chord (In.) | Actual Chord (In.) | Twist Angle (Deg) (0) | Maximum Thickness (In.) | Design Percent Maximum Thickness | Design Chamber — |
|---|---|---|---|---|---|---|
| 0 | 6.00 | 5.45 | 0 | 1.200 | 20 | NACA 63 |
| .5 | 6.25 | 5.58 | 5 | .875 | 14 | 64 |
| 1.0 | 6.25 | 5.71 | 10 | .562 | 9 | 65 |
| 1.5 | 6.00 | 5.85 | 14 | .480 | 8 | 65 |
| 2.0 | 6.00 | 5.96 | 17 | .425 | 7.08 | 65 |
| 2.5 | 6.00 | 6.00 | 20 | .370 | 6.16 | 65 |
| 2.75 | 6.00 | 6.00 | 21.5 | .343 | 5.72 | 65 |
| 3.0 | 6.00 | 6.00 | 23 | .315 | 5.25 | 65 |
| 3.5 | 6.00 | 5.75 | 25 | .260 | 4.33 | 65 |
| 4.0 | 5.50 | 5.25 | 27 | .205 | 3.73 | 65 |
| 4.5 | 4.50 | 3.75 | 29 | .150 | 3.33 | 65 |
| 4.75 | — | — | 30 | .080 | — | — |

RAKE ANGLE = 15. Deg. (For Y > 1 in.)
BLADE SPAN = 5.0. ins.
BLADE AREA = 27 sq. ins.
BLADE MEAN AERODYNAMIC CHORD = 5.5 ins.
BLADE PIVOT CENTER = 3.1 ins. AFT OF ROOT CHORD LEADING EDGE
BLADE PIVOT CENTER = 2.6 ins. AFT OF LEADING EDGE (47.3% MAC)
HUB RADIUS = 2.3 ins. (Y = O Station)

When operating the variable pitch propeller of the present invention, the propeller is, for example, secured to a conventional outboard engine or stern drive system; the drive shaft from the outboard engine is slip fitted along spline 50, protected by end cap 150, and secured between a retaining nut (not shown) on the end of the drive shaft (also not shown), and a thrust washer (not shown) abutting against the forward end of the spline member 250, such that the entire propeller unit is rotatable with the drive shaft. In this embodiment, an annular layer of an elastic material 51 is located between the inner hub 113 and spline coupling 50. This elastic layer 51 provides a means for isolating any vibration and/or shock from the drive system. No other modification to the engine or drive train is necessary.

When the propeller begins to rotate from a rest position, the blades 47 are in a low pitch position, e.g. at a pitch of 15 inches, for a boat weighing 2000 lbs., 16 ft long and having a single stern drive engine generating its maximum power of 120 horsepower at 4200 rpm with the propeller rotating at approximately ½ engine speed. The pitch changing system is in the position shown by FIG. 4 and FIG. 5, such that the three actuating weights 23 are in the radially inward-most position, and the bell crank linkages 112 are in the locked position shown in FIG. 5.

In the low-pitch position, the anchor pin 1, the bell crank pins 7, 8 and the blade arm pin 9 are positioned substantially along a straight line. In this position, any turning moment applied against the blade arm 3 to turn the blade 47 about its pivot center 10 will be resisted by a force transmitted from the arm 3 through the blade arm pin 9, bell crank 4 and the end link 5 to the anchor pin 1. The force acting through the anchor pin 1, which would otherwise tend to rotate the coordinating ring 11, is opposed by a sideward force against the slide bearing 12, secured to the propeller hub 13 and slidably inserted into the slot through the coordinating ring 11 defined by a surface 111. This locking linkage thus prevents premature rotation of the blades 47.

In the preferred embodiment shown in FIG. 5, the bell crank assembly 112 is positioned slightly over-center, i.e., the end of bell crank 4, and the pin 7 it holds, are below the line between the bell crank pivot pin 9 and the anchor pin 1. This over-centered position provides additional locking security against early release. Also, this overcenter position provides a control force feedback for altering the lock release timing depending upon the blade hydrodynamic loading. Under the high loads resulting from rapid boat acceleration conditions, the resultant hydrodynamic force is high and the center of pressure is positioned forward, near the aerodynamic center; this results in a high hydrodynamic turning moment about the blade pivot axis, acting to turn the blade toward higher pitch. This turning moment is countered by a force reaction at the blade arm pin 9 which is also the pivot center of the bellcrank locking mechanism.

When the locking mechanism is in the overcenter position, the force reaction acting on pin 9 arising from the hydrodynamic turning moment will tend to hold the locking mechanism in the overcenter or locked position. Thus, the greater the hydrodynamic turning moment, the greater the overcenter locking force. Since the lock release force biasing means is derived from centrifugal forces, a higher propeller rotational speed (rpm) will be required to overcome the higher hydrodynamic locking force component. This design arrangement provides the desirable effect of having the engine speed accelerate to a higher rpm before the shift in blade position from low to high pitch occurs during higher boat loading, or faster acceleration, conditions than during lower loading, or slower acceleration, conditions.

The magnitude of the hydrodynamic turning moment locking force feedback can be regulated by the magnitude of the overcenter position of the links as established by the link stops 105, 106, where the first stop 105 governs the overcenter locked position when the blades are locked in low pitch, while stop 106 governs the overcenter position when the blades are locked in high pitch. It should be noted that the locking mechanism, when positioned in the low pitch position provides a locking force feedback for boat acceleration conditions. Conversely, the locking mechanism, when positioned in the high pitch position, provides a locking force feedback for boat deceleration conditions.

The stop stubs 105, 106, are incorporated into the inner end of each of the end links 5, 6, respectively. Each stop stub 105, 106 is less than one-half the height of its respective link 5, 6, and thus includes a contact surface 14*a* located beyond the center line of the link, and is intended to make contact with the bell crank pivot pin 9, to limit the extent of the over-center angle. The over-center angle, is measured by the line drawn between an anchor pin 1, 2 and the pivot pin 9 and the line between an anchor pin 1, 2 and its respective link pin 7, 8. The over-center angle, beta (B), is preferably in the range of from about 0.5 to about 5 degrees, and most preferably from about 1.5 to about 2.5 degrees.

Figure 6A:
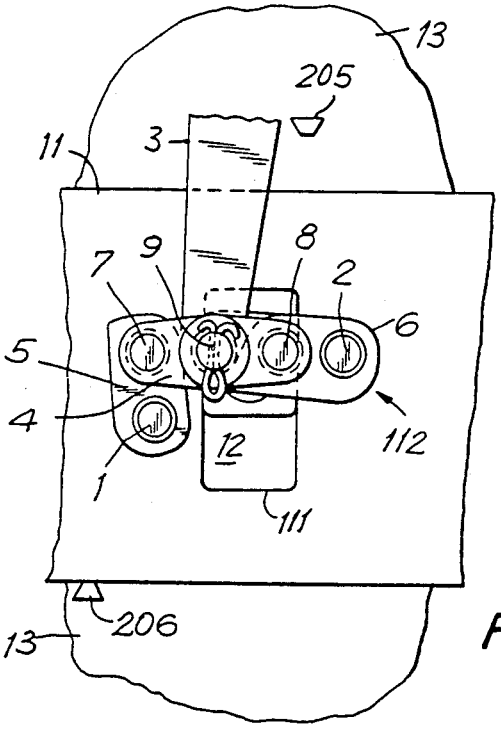
Figure 7A:
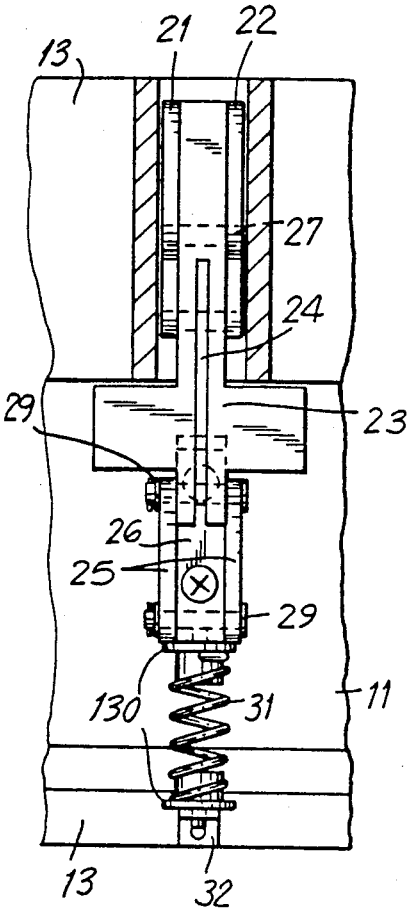
FIGS. 7 and 7*a* are cross-sectional views showing the actuating means in the high pitch and low pitch position, respectively, and taken along lines 7 of FIG. 3.
Figure 7:
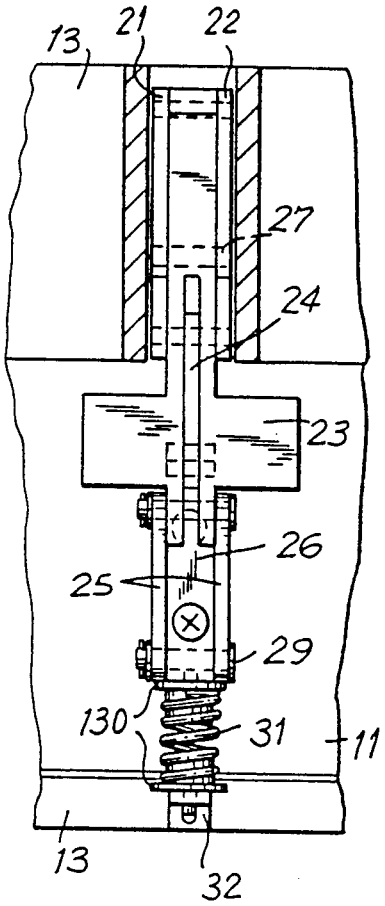

As an alternative, the stop stubs 105, 106 can be replaced by a pair of stop ridges 205, 206, formed on the interior surface of the hub 13, as shown in FIG. 6*a*. The upper stop ridge 205 limits the movement, towards the low pitch position, of the coordinating ring 11, such that the desired over centered relationship between the link pins 1, 7, and 9 is attained; the lower ridge stop 206 limits the movement, towards the high pitch position of the coordinating ring, such that the desired relationship between link pins 2,8, and 9 is attained.

As the engine speed increases, and the rotational speed of the propeller assembly increases, centrifugal forces acting on the actuating weights 23 also increase, causing the weights 23 to shift radially outwardly towards the outer hub 13. The actuating weight 23 is biased towards the radially inward position shown in FIG. 4 by the spring force of spring 31 acting against the coordinating ring 11 which in turn acts through the support links 24, 25 on the actuating weight 23. As the centrifugal force exerted by the weight 23 increases, it acts against the biasing force of the spring 31, until the centrifugal force exceeds the spring 31 bias force, the locking mechanism 112 over-center force component, and friction; the weight 23 will then move radially outwardly, thereby causing pivoting of the connecting links 21, 22, 24 and 25, acting against the coordinating ring 11 to move it in a forward direction, against the pre-load force of the spring 31, to the high-pitch position. The high pitch position, for the actuating weights 23 and the coordinating ring 11, is shown in FIG. 4*a*.

The pitch change actuating mechanisms 123 are so designed as to increase its mechanical advantage as the actuating weight 23 swings radially outwardly, i.e., towards the hub case 13, thereby increasing the force acting on the coordinating ring 11, in opposition to the bias force of the spring 31. Thus, the force generated by the actuating weight 23 as it swings outwardly is greater than the spring rate of the spring 31, thereby insuring a continuous and smooth forward movement of the coordinating ring 11. Further insuring this smooth movement of the ring 11 is the reduction in the effect of friction, i.e., from static friction to sliding friction, and the release of the locking linkage 112. Also, the mechanical geometry of the actuating mechanism 123 is designed to provide that the rotational speed of the propeller must be reduced to a substantially lower rpm to cause the blades to return to the low pitch position, than is required to cause the mechanism to move to the high pitch position. This tends to reduce premature release of the locking mechanism when down shifting, and improves the smoothness of the pitch change movement.

Figure 4:
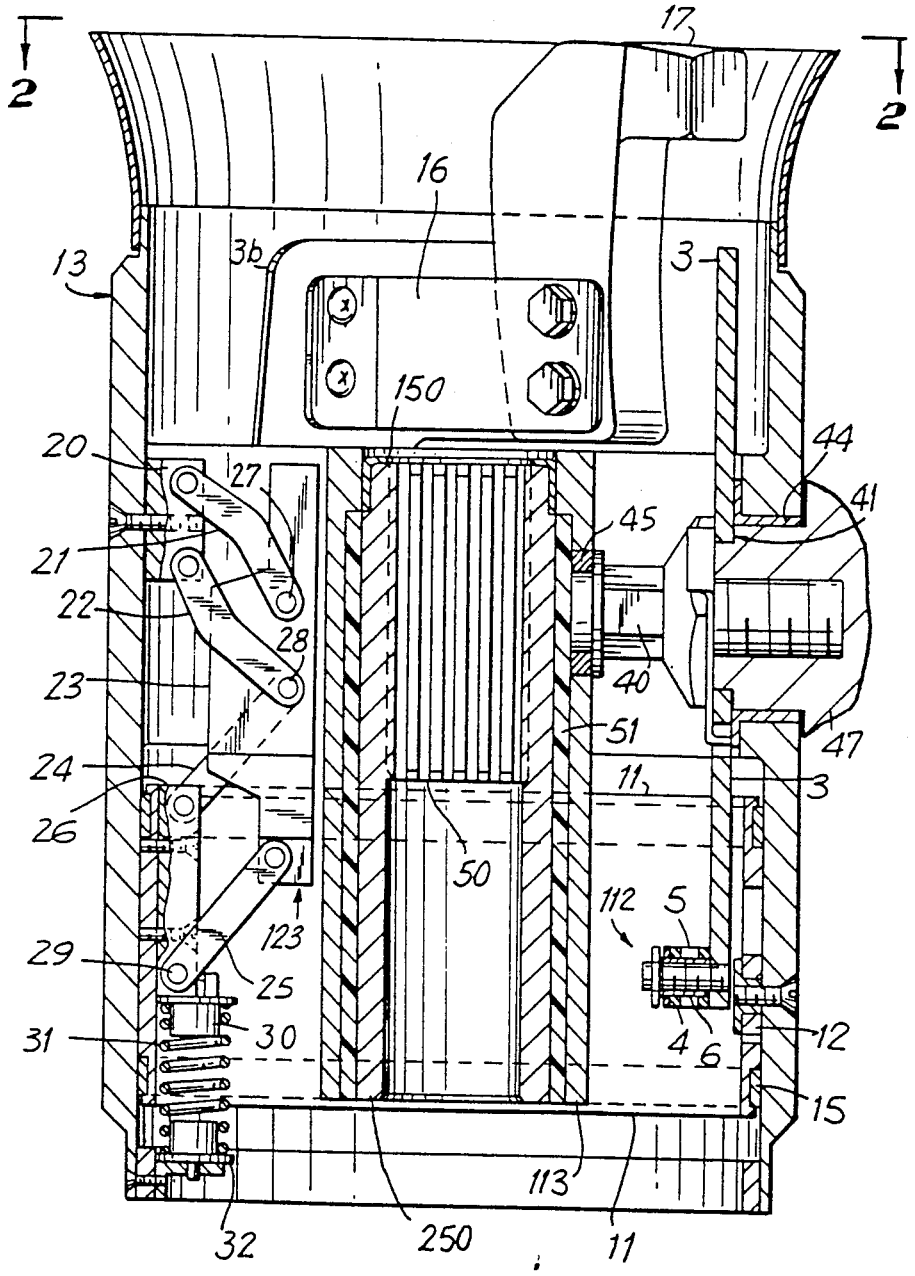
FIG. 4 is a cross-sectional view taken along lines 4 of FIG. 3.
Figure 4A:
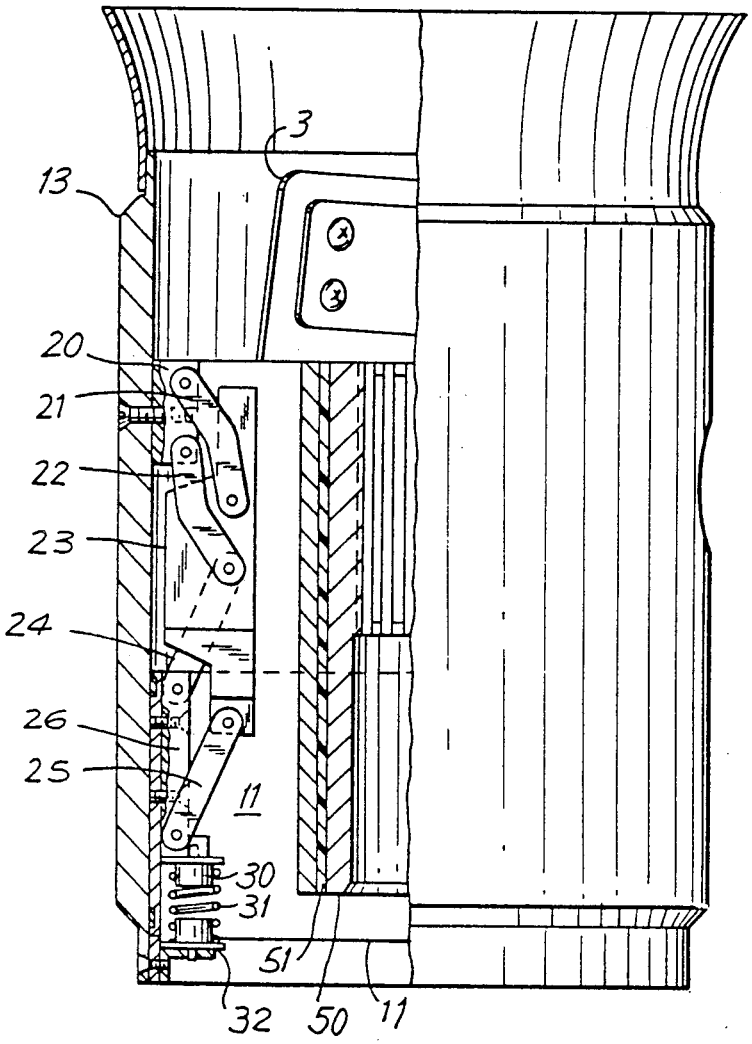
FIGS. 4*a* and 5*a* are high pitch-position representations of the views of FIGS. 4 and 5, respectively.
Figure 13:
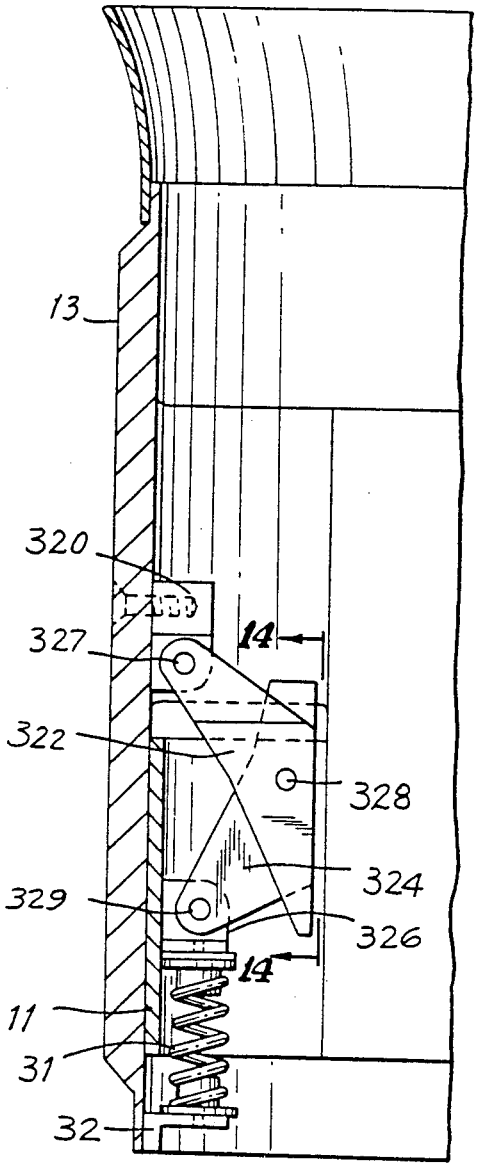
FIG. 13 and 13*a* each is a partial longitudinal cross-sectional view of another embodiment of this invention, showing the device in a low pitch position and high pitch position, respectively.
Figure 13A:
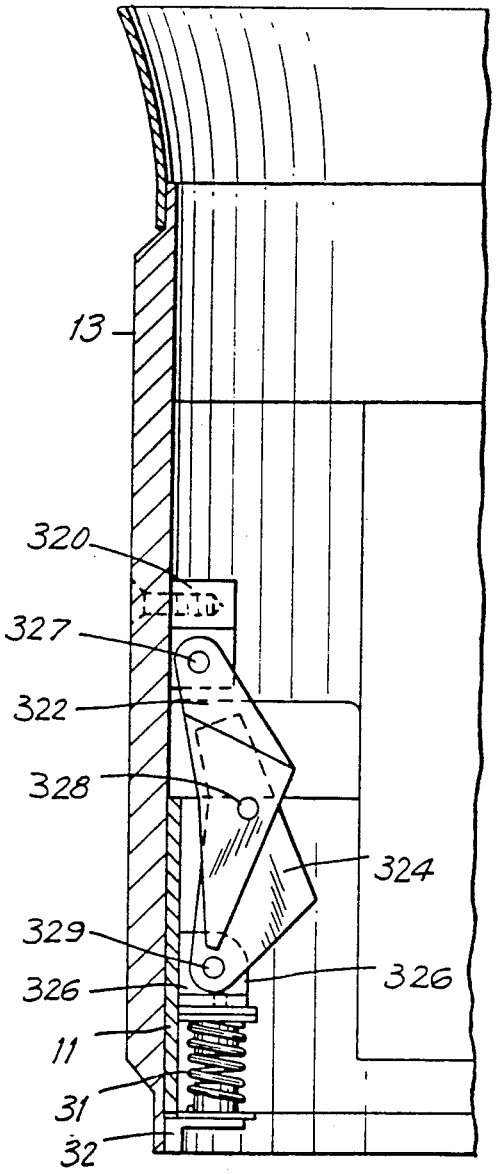
Figure 15:
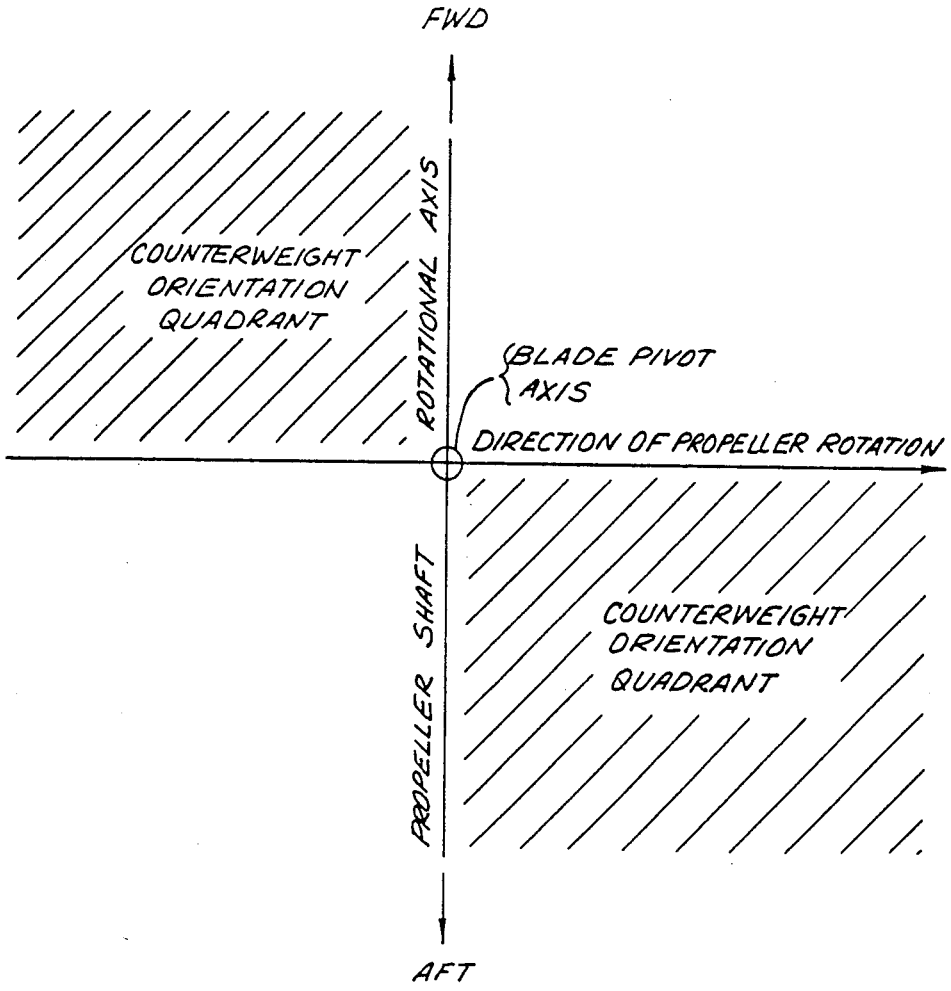
FIG. 15 is a vector diagram for the operation of the propeller of this invention, viewing radially inward along the blade pivot axis Y—Y.

An alternate arrangement of the actuating weight mechanism shown in FIGS. 4 and 4*a*, is shown in FIGS. 13, 13*a*, and 13*b*. In this alternate arrangement fewer parts are used, but the function of the mechanism is the same. The inertial actuating weight mass is provided integrally on the toggle links 322, 323, 324. At rest, the linkage is biased by the spring force towards the low pitch position of FIG. 13. The spring 31 acts between its main support 32, rigidly secured to the hub 13, and the slider block 326 secured to the coordinating ring 11. Links 322, 323 are pinned to the slider block 326, and link 322 is pinned to the hub block 320. The second end of all the links 322, 323, 324 are pinned together by pin 328. For the alternate embodiment of FIG. 13, 13*a*, and 14, the operation of the mechanism is as follows:

As the engine speed increases, and the rotational speed of the propeller assembly increases, centrifugal forces acting on the mass of links 322, 324, and 323 also increase, causing the links to rotate radially outwardly about pivots 327 and 329 and towards the outer hub 13. The toggle links 322, 324, 323 are biased towards the radially inward position (shown in FIG. 13) by the spring force of spring 31 acting against the coordinating ring 11, which in turn acts through the toggle links 324, 322, 323. As the centrifugal force exerted by the links 322, 323, 324 increases, it acts in a direction opposite to the biasing force of the spring 31. When the centrifugal force exceeds the spring 31 pre-load bias force, the locking mechanism 112 over-center force component, and friction, the links 324, 322, 323 move radially outward, thereby causing pivoting of the links about the pivot centers 327, 328, 329 and push against the slider block 326; this causes the axial movement of the coordinating ring 11 in a forward direction, to the high-pitch position, against the pre-load force of the spring 31. The high-pitch position, for the actuating mechanism and the coordinating ring 11, is shown in FIG. 13*a*.

The links 324, 322, 323 are so designed as to increase the mechanical advantage of the net actuating weight as the links swing outwardly, i.e., towards the hub case 13, thereby increasing the force acting on the coordinating ring 11 in opposition to the bias force of spring 31. Thus, the increase in inertial force generated by the net actuating weight of links 324, 322 323 as they swing outwardly is greater than any increase in the spring rate of the spring 31, thereby insuring a continuous and smooth forward movement of the coordinating ring 11. Further insuring this smooth movement of the ring 11 is the reduction in the effect of friction, i.e., from static friction to sliding friction, and the release of the locking linkage 112.

The rotation of the entire propeller assembly also results in the generation of a centrifugal inertial force on the counter weights 17 secured to the rear-most end of each blade arm 3. The counter weights 17 are so oriented relative to the blade pivot axis y—y, that the centrifugal forces acting on the counter weights 17 generate turning moments ("$M_{cw}$") about the blade pivot axis directed toward rotating the blades 17 toward a higher pitch angle.

Figure 14:
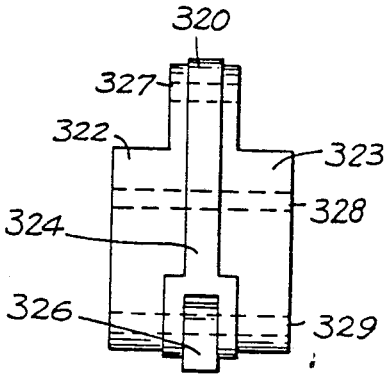
FIG. 14 is a cross-sectional view taken along lines 13 of FIG. 13.

To be effective, the counterweights must be positioned such that their center of gravity and mass distribution are in one of two preferred quadrants relative to the blade pivot axis and propeller shaft axis; see FIG. 14. The location of the counterweight center of gravity is positioned either aft of the blade pivot center, relative to the shaft axis, and offset toward the direction of propeller rotation relative to the pivot axis or, alternately, positioned forward of the blade pivot axis, relative to the shaft axis, and offset opposite to the direction of propeller rotation relative to the pivot axis. When the counterweight center of gravity (and mass distribution)

is placed in these preferred quadrants, the mass inertial forces tending to align the counterweight mass in a plane normal to the shaft axis will complement the desired bias toward higher pitch as the counterweight moves radially outward. Conversely, if the counterweight center of gravity is positioned in either of the two non-preferred quadrants, this mass inertial component will oppose the desired bias toward high pitch.

An approximate magnitude of the inertial turning moment for the counter-weights can be obtained from the following equation (which is a simplification of the equation in FIG. 12).

$$M_{cw}=Xd(mW^2),$$

wherein X is the shaft axial distance between the counterweight c.g. (assuming all of the mass is concentrated at that point) and the blade pivot axis y—y (ins); d is the offset distance to the counter-weight center of gravity from the propeller shaft rotational axis (ins.); m is the counter-weight mass (lbs.), and W is the propeller rotational velocity (radius per second).

As the rotational velocity of the propeller assembly and boat speed increases, the centrifugal force turning moments generated by the counter weights 17 ($M_{cw}$) increase until they exceed the sum of the opposing forces, i.e., the inertial turning moments generated by the blades 47 ($M_B$), plus the resultant hydrodynamic turning moment (R'g) acting on the blades 47, plus any internal friction.

Empirical results have shown that for the particular design system shown in these drawings, the necessary counter-weight mass should be in the range of 0.7 to 1.1 times the mass of the blade. This relationship is based upon a relatively low co-efficient of friction, i.e., less than 0.3, such as is obtained when metal parts are in contact with plastic bushings, such as of acetal resin e.g. Delrin. More generally, $M_{cw}$ is preferably about two to about four times larger than $M_B$, when the pitch shift occurs towards higher pitch.

Upon the release of the bell crank linkage locking mechanism 112 by the displacement of the coordinating ring 11, the propeller blades 47 are allowed to turn to the high pitch position as soon as the turning moment $M_{cw}$ in that direction exceeds the moments acting in the opposite direction. Thus, as the propeller rotational speed increases, and the center of pressure of the resultant hydrodynamic force moves toward the blade trailing edge 247, reducing the feedback locking load, the blades 47 will then turn to the high pitch position. The movement of all of the blade arms 3 is coordinated through the bell crank linkages 112 and the axial travel of the coordinating ring 11, such that all three propeller blades 47, in this embodiment, rotate substantially simultaneously and equally.

Figure 5A:
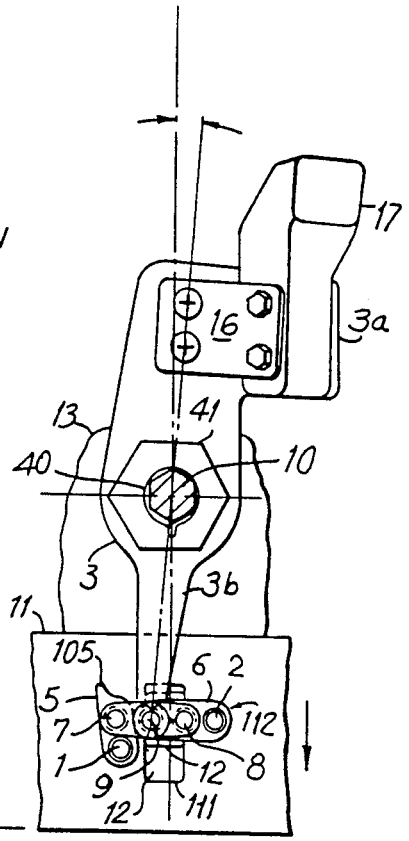

The rotation of each of the blades 47 terminates as soon as the bell crank linkages 112 are each in the position shown in FIG. 5*a*; the linkage 112 is in an overcenter locked position, preventing further movement of the blade arm 3, about its pivot point 10, in either direction. In this case, the over-center locking angle is determined by the stub 106 on the end of the other link 6, abutting against the bell crank pin 9. The angular distance moved on either side of the axial plane, as indicated by the angle alpha ($\alpha$) in FIG. 5 and theta ($\theta$) in FIG. 5*a*, need not be equal.

When locked into the high pitch position, any turning moment on the blades back towards the low pitch position is resisted by the force translated through blade arm 3, the pins 7, 8 and the links 4, 6 to the anchor pin 2. Again, the force on the anchor pin 2, tending to rotate the coordinating ring 11, is opposed by the other surface of the slide bearing 12 within the slot 111 in the coordinating ring 11.

Upon deceleration of the boat and engine and reduction of the rotational speed of the propeller, at the point that the sum of the centrifugal force component generated by the actuating weight 23, plus the force component of the locking mechanism 112, plus friction, is exceeded by the spring force component exerted by the return spring 31, the coordinating ring 11 starts to move axially rearwardly. This unlocks the bell crank assemblies 112, permitting the blade arms 3 to rotate together with the blades 47 towards the low pitch position, as soon as the centrifugal force exerted by the counterweights 17 is exceeded by the net turning moment on the blades 47 tending towards the low pitch position. Again, the coordinating ring 11 acting along with the blade arms 3, causes the blades 47 to all rotate substantially simultaneously and equally. To reduce friction and to promote even and regular movement of the coordinating ring 11, thin, low friction material (e.g. Teflon) glide rings 15 are provided around the outer surface of the coordinating ring 11.

It is noted that the structural drawings are drawn to scale. In the illustrated example, the propeller diameter is 14.3 ins., and the hub diameter is 4.6 ins. The weight of each blade 47 is 13 oz., the blade plan form area is 27 ins., and the length of the blade arm 3 is 2.28 ins. The counter-weight 17 weighs 12 oz., the shaft axial distance, X, between the counter-weight center of gravity ("c.g.") and blade pivot axis Y—Y is 2.37 ins.; and the offset distance, d, of the counter-weight c.g. is 1.62 ins., when in the low pitch position. The activating weight 23 weighs 3 oz. and its c.g. is located 1.24 ins. radially from the hub centerline when in the low pitch position. The biasing spring 31 has a spring constant of 22 lb./in and is compressed to provide an initial preload of 8 lbs in the low pitch position.

When the locking mechanism over-center angle is about 2 degrees, the difference in the upshifting point propeller speed between light engine load and heavy engine load is about fifteen percent, e.g., from about 1700 rpm to about 2000 rpm.

The angular displacement of the blades from low to high pitch position is approximately 8 degrees. When positioned in the low pitch position, the propeller performance is comparable to that provided by a 14-inch pitch fixed pitch propeller, and when positioned in the high pitch position, the propeller performance is comparable to that provided by an 18-inch pitch fixed pitch propeller, for propellers having equivalent hydrofoil geometry.

These drawings show preferred embodiments comprising a locking linkage and actuating mechanism associated with each blade, e.g., three blades 47, three locking linkages 112, and three actuating, or lock-releasing, mechanisms 123. However, the numbers of blades, locking linkages and actuating mechanism, need not be equal.

The propeller is preferably constructed of aluminum and/or other corrosion-resistant materials, such as bronze, stainless steel or other corrosion-resistant metal, or impact-resistant non-metals, such as polycarbonates, acetals or reinforced polymers.

The patentable Embodiments of the Invention which are claimed are as follows:

1. A variable pitch marine propeller comprising a hub case; drive securing means designed to secure the propeller to a rotating drive shaft on a boat such that the entire propeller rotates with the drive shaft; a plurality of blades extending radially outwardly from the hub case and comprising a hydrodynamic surface and a retainer shaft means extending axially from the hydrodynamic surface and being pivotally secured to the hub case such that each blade is mounted to the hub case for pivotal movement about a blade axis between two extreme angular pitch positions: a first locked angular position defining a lower pitch position, and second angular position defining a high pitch position; pitch shifting means comprising a mass member operably secured to the retainer shaft means and designed to cause the blade to pivot from one angular position to the other angular position in response to the reaction force generated upon rotation of the propeller; positive locking means comprising a locking member operably connected between the hub case and the retainer shaft means for preventing pivoting of the blade in response to the pitch shifting means when the blades are in the first locked angular position; and release means comprising a second mass member operably engaging the locking member and designed to move in response to the rotation of the propeller at a minimum threshold rotation velocity so as to release the locking means and to permit the pitch shifting mass to cause the pivoting of the blades.

2. The variable pitch marine propeller of claim 1, wherein rotation of the propeller causes a resultant hydrodynamic force to be exerted on each blade hydrodynamic surface, and the propeller further comprising a force transmitting member operably secured between a blade and the locking member, for transmitting the resultant hydrodynamic force from the blade to the locking means, the transmitting member and the locking means being so interconnected that the resultant hydrodynamic force increases the locking force effectiveness of the locking means.

3. The variable pitch marine propeller of claim 2, wherein the release means comprises in addition a release member operably connected between the second mass member and the locking member, wherein the locking means comprises a series of three mutually pivotal members: the locking member forming a center member and two outer members, each outer member pivotally secured to the central member adjacent one end and each outer member being pivotally pinned to the release member at a second end; and wherein the force transmitting member comprises a blade actuating arm which is secured at one location to the blade retainer shaft, extends within the hub case transversely to the blade axis, and is pivotally pinned at another location to the central member of the locking means.

4. The variable pitch marine propeller of claim 3, wherein the second mass member is pivotally secured between the hub case and the release member so as to cause relative movement between the hub and the release member when the second mass member is caused to move in response to rotation of the propeller.

5. A variable pitch marine propeller comprising a hub case; drive securing means designed to secure the propeller to a rotating drive shaft on a boat, such that the propeller rotates with the drive shaft; a plurality of blades extending radially outwardly form the hub case, a blade shaft secured to each blade and extending radially inwardly of, and journalled to, the hub case, such that each blade is mounted to the hub case for pivotal movement, characterized by each blade being pivotable between two locked angular positions, a first locked angular position defining a lowest pitch position and a second locked angular position defining a highest pitch position; a moment arm member secured to each blade shaft and extending within the hub case substantially perpendicular to the blade shaft; a counter-weight secured to an end portion of each moment arm member in a position such that rotation of the propeller generates a turning moment on the blade shaft tending to turn the blade towards a higher pitch position; a two-position affirmative locking means operatively connected to the moment arm member for preventing pivoting movement of the moment arm member so as to secure the blade to one of the two locked angular positions; release means comprising actuating means and a release member, the actuating means comprising a mass member pivotally secured to the hub case so as to generate in reaction to the propeller being rotated a minimum threshold rotational velocity, and the release member being operably connected between the actuating means and the locking means, such that movement of the release member in response to the actuating member releases the locking means, thus permitting movement of the moment arm and pivoting of the blade to the second locked position and movement of the locking means from one locked position towards the second locked position.

6. The variable pitch marine propeller of claim 5, wherein the actuating means comprises an actuating weight located within the hub case and pivotally connected to the release member and to the hub case, such that rotation of the marine propeller causes the actuating weight to move radially outwardly and to move the release member relative to the hub case; and the propeller further comprises biasing means operably connected to the locking means and designed to act in opposition to the actuating forces generated by the actuating weight up to a maximum magnitude of force.

7. The variable pitch marine propeller of claim 6, wherein the biasing force means comprises a spring.

8. The variable pitch marine propeller of claim 6, comprising, within the hub case, locking means and actuating weights operably connected to each blade.

9. The variable pitch marine propeller of claim 8, wherein the release member comprises a rigid member slidably positioned within the hub and operably connected to each locking means, the rigid member being so arranged as to translate axially along the propeller shaft axis, the rigid member and the locking means being so juxtaposed that axial motion of the rigid member along the propeller shaft axis release and relocks the locking means and coordinates the simultaneous pivoting of the blades.

10. The variable pitch marine propeller of claim 9, wherein the rigid member is an annular ring which is restrained from rotation about the drive shaft axis.

11. The variable pitch marine propeller of claim 10, wherein the release means further comprises a four-bar toggle-slider linkage mechanism comprising a rocker link, a coupler link and the ring, acting as a slider link, the rocker link being pivotally pinned to the hub and to the coupler link, and the coupler link being pivotally pinned to the rocker link and the ring, the links being so juxtaposed within the hub that rotation of the propeller generates a centrifugal force acting on the linkage mechanism tending to move the ring axially along the propeller shaft axis towards the second locked position.

* * * * *

UNITED STATES PATENT AND TRADEMARK OFFICE

CERTIFICATE OF CORRECTION

PATENT NO. : 4,929,153

DATED : May 29, 1990

INVENTOR(S) : Stephen R. Speer

It is certified that error appears in the above-identified patent and that said Letters Patent is hereby corrected as shown below:

Col. 15, claim 1, line 28, change "rotation" to --rotational--.

Signed and Sealed this

Sixteenth Day of July, 1991

*Attest:*

HARRY F. MANBECK, JR.

*Attesting Officer*

*Commissioner of Patents and Trademarks*